US011684864B1

(12) United States Patent
O'Dell

(10) Patent No.: US 11,684,864 B1
(45) Date of Patent: Jun. 27, 2023

(54) TYING TOOL

(71) Applicant: Brian Dwayne O'Dell, Stillwater, OK (US)

(72) Inventor: Brian Dwayne O'Dell, Stillwater, OK (US)

( * ) Notice: Subject to any disclaimer, the term of this patent is extended or adjusted under 35 U.S.C. 154(b) by 601 days.

(21) Appl. No.: 16/779,652

(22) Filed: Feb. 2, 2020

Related U.S. Application Data

(60) Provisional application No. 62/801,031, filed on Feb. 4, 2019.

(51) Int. Cl.
*A63H 27/10* (2006.01)
*B65H 69/04* (2006.01)

(52) U.S. Cl.
CPC ..... *A63H 27/10* (2013.01); *B65H 69/04* (2013.01); *A63H 2027/105* (2013.01); *A63H 2027/1041* (2013.01)

(58) Field of Classification Search
CPC .... A63H 2027/105; A63H 27/10; B65H 69/04
See application file for complete search history.

(56) References Cited

U.S. PATENT DOCUMENTS

| | | | | |
|---|---|---|---|---|
| 2,396,906 | A | 3/1946 | Windson | |
| 3,476,423 | A | 11/1969 | Kentfield | |
| 3,993,230 | A * | 11/1976 | Oakes | B65H 35/0026 225/56 |
| 4,989,906 | A | 2/1991 | Peverley | |
| 5,039,142 | A | 8/1991 | Muma | |
| 5,314,217 | A | 5/1994 | Place | |
| 5,568,950 | A * | 10/1996 | Herren | A63H 27/10 289/17 |
| 5,609,175 | A | 3/1997 | Gerry et al. | |
| 5,611,578 | A | 3/1997 | Angelico et al. | |
| 5,647,615 | A | 7/1997 | Messier | |
| 5,882,051 | A | 3/1999 | Dreger et al. | |
| 6,082,785 | A | 7/2000 | Morgan et al. | |
| 6,227,580 | B1 | 5/2001 | Sundby | |
| 6,286,173 | B1 | 9/2001 | Briones | |
| 6,325,426 | B1 | 12/2001 | Boesl | |
| 6,540,267 | B1 | 4/2003 | Rohbock et al. | |
| 6,902,212 | B1 * | 6/2005 | Mize | A63H 27/10 289/17 |
| 7,549,683 | B1 | 6/2009 | Sikorcin | |
| 7,685,684 | B1 * | 3/2010 | James | A01K 91/04 24/129 R |
| 7,967,344 | B2 | 6/2011 | Herren | |
| 8,141,326 | B2 | 3/2012 | Wang | |
| 8,292,335 | B1 | 10/2012 | Hemingway | |
| 2007/0028727 | A1 | 2/2007 | Schiller | |
| 2011/0253255 | A1 | 10/2011 | Dellaquila et al. | |
| 2012/0085430 | A1 | 4/2012 | Johansson et al. | |
| 2015/0027280 | A1 | 1/2015 | Euloth | |
| 2016/0059141 | A1 | 3/2016 | Plouffe | |

FOREIGN PATENT DOCUMENTS

| | | | | |
|---|---|---|---|---|
| CN | 104274978 | A | 1/2015 | |
| CN | 206867718 | U * | 1/2018 | |
| DE | 19610585 | A1 * | 9/1997 | A63H 27/10 |
| DE | 202016103231 | U1 * | 9/2017 | |

* cited by examiner

*Primary Examiner* — Daniel J Colilla

(57) ABSTRACT

A tool to assist with hand-tying of knots in balloons, cords, and the like. The tool has a head consisting of a hollow tube with an opening running the length of the tube. The tube is typically tapered with a flange toward the larger end, and the opening is incorporated at an angle nonparallel to the center line of the tube, forming a notch feature that passively retains material on the head until removed by the user. The head is connected to a handle with two or more functionally independent finger loops. The tool may be retained on the hand without unduly impeding dexterity and provides for greater control of the tool when in use.

5 Claims, 4 Drawing Sheets

TYING TOOL

CROSS-REFERENCE TO RELATED APPLICATIONS

This application claims the benefit of provisional patent application Ser. No. 62/801,031, filed 2019 Feb 4 by the present inventor.

TECHNICAL FIELD

The present invention relates to tying tools, and more particularly to tools for tying balloons, cord, rope, and similar media.

BACKGROUND-PRIOR ART

The following is a tabulation of some prior art that presently appears relevant:

U.S. Pats.

| Patent Number | Kind Code | Issue Date | Patentee |
|---|---|---|---|
| 2,396,906 | | 1946-03-19 | Windson |
| 3,476,423 | | 1969-11-04 | Kentfield |
| 4,989,906 | A | 1989-08-07 | Peverley |
| 5,039,142 | A | 1991-08-13 | Muma |
| 5,314,217 | A | 1994-05-24 | Place |
| 5,568,950 | A | 1996-10-29 | Herren |
| 5,611,578 | A | 1997-03-18 | Angelico et al. |
| 5,647,615 | A | 1997-07-15 | Messier |
| 5,882,051 | A | 1999-03-16 | Dreger et al. |
| 6,082,785 | A | 2000-07-04 | Morgan et al. |
| 6,227,580 | B1 | 2001-05-08 | Sundby |
| 6,325,426 | B1 | 2001-12-04 | Boesl |
| 6,540,267 | B1 | 2003-04-01 | Rohbock et al. |
| 6,902,212 | B1 | 2005-06-07 | Mize |
| 7,549,683 | B1 | 2007-09-10 | Sikorcin |
| 8,292,335 | B1 | 2009-07-10 | Hemingway |
| 7,967,344 | B2 | 2011-06-28 | Herren |
| 8,141,326 | B2 | 2012-03-27 | Wang |

U.S. Pat. Application Publications

| Patent Number | Kind Code | Publ. Date | Appliant |
|---|---|---|---|
| 2016/0059141 | A1 | 2016-03-03 | Plouffe |
| 2012/0085430 | A1 | 2012-04-12 | Johansson et al. |
| 2011/0030844 | A1 | 2011-02-10 | Wang |
| 2011/0253255 | A1 | 2011-10-20 | Dellaquila |

Foreign Patent documents

| Foreign Doc. NR. | Country Code | Kind Code | Pub. Dt | App or Patentee |
|---|---|---|---|---|
| 20120056025 | KR | A | 2012-06-01 | Gil et al. |
| 2250032 | GB | A | 1992-05-27 | Jones et al. |
| 104274978 | CN | A | 2015-01-14 | Sun |

It is common to tie knots in cords, strings, and the like for the purpose of securing these materials to other objects, to terminate the end of these materials (e.g., to prevent fraying of the ends, etc.), or, in the case of balloons, to close off the inlet to the balloon and prevent entrapped gasses from escaping. While this often can be done by hand, a tool to assist with the tying process is needed to reduce hand fatigue, to protect hands from abrasion, and to perform the tying operation more quickly.

A variety of methods and devices have been devised to assist with tying balloons and other elastic media. Windson (1946) discloses a disk which, when affixed to an inflated balloon, prevents it from deflating. However, his device requires a separate disk to be permanently attached to each balloon.

Alternatively, several types of reusable tools have been proposed. A first type, which might be generically referred to as a slotted probe, consists of an elongated member, stick, or probe into which slots or other narrow features have been formed to retain one or more sections of the balloon and make tying a knot easier. Examples of this type include U.S. Pats. 5,039,142 (1991) to Muma, 5,314,217 (1994) to Place, 5,611,578 (1997) to Angelico et al., 6,082,785 (2000) to Morgan et al., and 7,549,683 (2007) to Sikorcin. Johansson et al. (2012) uses a similar technique to others in this type, though it is a more complex device incorporating an inflation pump, as well. Boesl (2001) similarly employs slots at the end of a rod as holding features, though this device is hollow rather than solid as some of the others. All of these devices involve gripping the device in the palm of the hand while tying the balloon with the other. This hinders dexterity because the fingers of the tool hand cannot be used to help secure the balloon or otherwise assist in the tying operation. Peverley (1989) also consists of a rod with a slot through which to pass the end of the balloon, but it is designed to be affixed to a gas tank, limiting the mobility of the operator.

A second type, generally referred to as a multi-post type, consists of two or more raised protrusions on the tool around which the material is wound and tied—for example, U.S. Pats. 5,647,615 (1997) to Messier, 6,540,267 (2003) to Rochbock, 6,902,212 (2005) to Mize, 8,292,335 (2009) to Hemingway, and 5,882,051 (1999) to Dreger et al., U.S. Pat. Application 20160059141 (2016) to Plouffe, and U.K. Patent Application 2250032 (1992) to Jones et al. Plouffe is held in the palm of a hand, suffering the same dexterity limitation as the slotted probe types discussed earlier. Messier and Rohbock are designed to be affixed to a desk or other solid surface, which limits mobility of the operator while the device is in use. Mize and Hemingway are held on the back of two fingers, but the two-post design presents a small gap through which the end of the balloon can be passed, in contrast to the designs of Plouffe, whose three-post design naturally creates a larger gap. Additionally, in both Mize and Hemingway the device is retained around the fingers by a single loop rather than independent finger holes, limiting mechanical stability and control, and if the loop or strap is snug enough to secure it to the fingers without gripping it, the strap will also hinder dexterity. Jones is a variant of these designs in which the posts are affixed to a disk held by the thumb and finger, which can cause fatigue rather quickly, as is the case for Dreger et al., where the posts protrude radially from the disk rather than axially as in Jones.

A third type features a hollow cylindrical structure with an opening running the length of it. Kentfield (1969) describes a tool for knotting bands together consisting of a handle-mounted cylinder with an opening on one side. With two or more bands wrapped around the cylinder, a separate pick is used to grab one of the bands, pull it through the cylinder, around the remaining bands, and thereby form a knot holding them all together. This design is not intended for forming simple knots in the end of a single piece of material, and it is gripped in the palm of one hand, limiting the user's dexterity. U.S. Pats. 5,568,950 (1996) and 7,967,344 (2011), both to Herren, describe a curved structure integral with a solid loop that is held on two fingers as in Mize, except that the tying feature is designed to be held toward the volar or palm side of the hand, rather than the dorsal or back side as in Mize. This keeps the working surface in closer proximity to the pinch point of the balloon where it is held by the thumb than in Mize, limiting the length that the balloon is stretched and consequently the amount of force needed to tie the knot. However, because the tool feature protrudes from the palm, it hinders the use of the tool hand from holding the balloon when inflating it. U.S. Pat. 8,141,326 (2012) and U.S. Pat. Application 20110030844 (2011), both to Wang, describe a similar curved tying tool, except that it is threaded for attachment to a water hose and includes a fill nozzle, while U.S. Pat. Application 20010253255 to Dellaquila (2011) is designed for attachment to a gas supply such as helium. Chinese Patent Application 104274978 (2015) to Sun is a simplified design intended to be held with a single finger via a short ring or tube; as such, it will quickly lead to user fatigue and discomfort due to the pressures it will apply to the hand, especially when wrapping an elastic material such as a balloon.

More complex tying mechanisms exist as well, such as U.S. Pat. 6,227,580 (2001) to Sundby and Korean patent application 20120056025 (2012) to Gil et al., but these devices are constructed from multiple moving parts, significantly increasing the cost of the device.

The available tying tools heretofore known suffer from one or more of the following disadvantages:

(a) Their operation may require the user to grip the device in the palm of the hand with the fingers. For tying balloons, this limits the use of the tool hand for other functions.

(b) If the device incorporates a loop to retain it on the fingers, the loop does not provide much leverage to help steady the device while a balloon is being tied.

(c) Some designs consist of multiple, moving parts, greatly increasing complexity and cost.

(d) Some designs are intended to be mounted to a solid surface, which limits their utility to applications where the filling operation is performed at one place.

(e) The designs may have multiple parts or include complex features which cannot be manufactured using a simple injection mold, which can increase production costs.

SUMMARY

In accordance with one embodiment a tying tool comprises a finger grip having two loops to which is attached a tapered tube having an opening running the length of the tube, where the walls of the opening are nonparallel to the tube's axis.

Advantages

Accordingly several advantages of one or more aspects are as follows: to provide a tying tool that can be held without unduly hindering the use of the operator's hands, that provides mechanical leverage while tying elastic media, that can be easily manufactured, that is a single-piece design, that has a notch which hinders the material being tied from slipping off, that can be used for tying a variety of cord-like materials inclusive of but not limited to balloons, and that is simple to use. Other advantages of one or more aspects will be apparent from a consideration of the drawings and ensuing description.

DRAWINGS — FIGURES

In the drawings, closely related figures have the same number but different alphabetic suffixes.

Figure 1A:
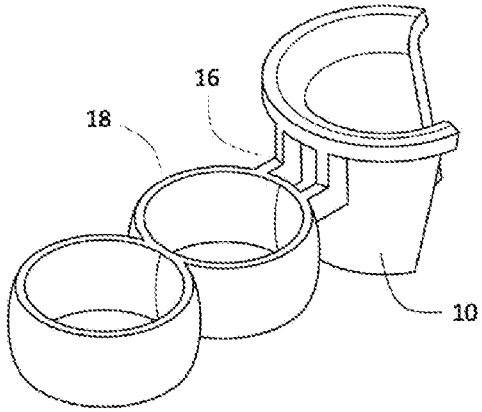
FIGS. 1A and 1B shows isometric views of an embodiment of the tying tool.

| Drawings — Reference Numerals | |
|---|---|
| **10** tool head | **11** junction of the handle rings |
| **12** opening in the tube wall | **14** flange |
| **16** support posts | **18** handle |
| **20** tool head centerline | **22** axis of cut of the opening |
| **24** edges of the opening | **26** notch |
| **30** body | **32** neck |
| **34** lip | **36** body-neck transition |
| **50** thumb rest | **52** curved corner |
| **60** spacer | **62** handle narrowing |
| **64** joined finger loops | **66** triple finger loops |
| **70** alternate opening edge | **72** alternate notch |
| **80** alternate head | **82** alternate head post |

DETAILED DESCRIPTION–FIGS. 1A, 1B, 2A, AND 2B–FIRST EMBODIMENT

Figure 1B:
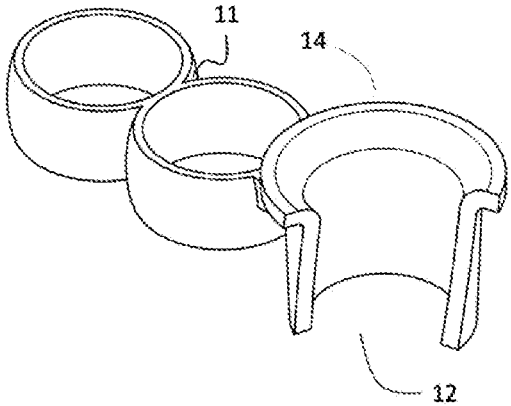

One embodiment of the tool is illustrated in FIG. 1A (left isometric view) and FIG. 1B (right isometric view). The tool has a head consisting of a hollow tube 10 with an cut, gap, or opening 12 running the length of the tube. The tube typically has a minimum interior diameter of 0.7 to 1.0 inches and is 0.9 to 1.0 inches in length, with a wall thickness of around 0.075 to 0.125 inches. The opening can be as wide as the interior diameter but is typically about 0.6 to 0.9 inches. In one embodiment, a flange, rim, or lip 14 is formed along one end of the tube, adding mechanical stiffness to the structure. If the tube is tapered, the lip will typically be on the end of the tube with the largest diameter. Corners and edges on the head are typically beveled or rounded to avoid snagging or cutting the material being tied (cf. FIG. 5, curved corner 52). The head is connected to a double-ring finger grip or handle 18 via a pair of support posts or braces 16, which are typically 0.3 to 0.4 inches long but can be dimensioned to provide more or less space between the tool head and the handle. Each of the rings is typically 1.00 to 1.25 inches in diameter and 0.4 to 0.6 in width, though these dimensions as well as the others previously described can be adjusted to accommodate different hand sizes, as an example. In one embodiment, the tool is a stiff plastic, such as nylon, polyethylene, or polypropylene. However, the tool can consist of any other material that can be repeatedly stressed without fracturing. Additionally, all or part of the tool may be coated with a compliant material such as silicone rubber or foam.

Figure 2A:
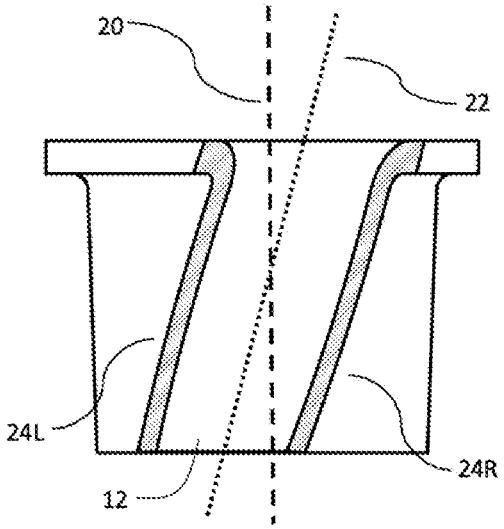
FIGS. 2A and 2B illustrate how an opening formed at an angle nonparallel to the tool's axis creates a notch to help retain material on the tool.
Figure 2B:
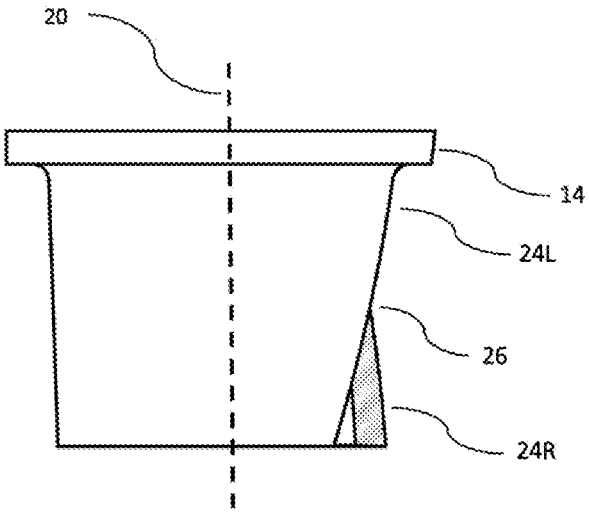

The tube is typically tapered from the flange side toward the opposite end to facilitate manufacture using injection molding, where the angle of this taper or draft is normally 0.5 to 2 degrees. FIG. 2A shows a front view of the opening 12 in the tube. In this figure, a dashed line 20 represents the center axis of the tube and a dotted line 22 illustrates the cut line of the opening relative to the center axis. Here, the opening is described as being cut from a solid tube to illustrate the feature; although it could be manufactured in this way, other manufacturing techniques could be used such as incorporating the feature into the design of an injection mold. Typically, the angle of the cut line to the center axis is between 20 and 30 degrees. In this embodiment, both the left 24L and right 24R edges of the opening are parallel to the cut line. FIG. 2B shows the profile view of the tube. As material is stretched around the tube, it spans the gap formed between the left and right edges. Due to both the curvature of the tube and the angle of the cut path 22 being nonparallel to the axis of the tube, the left edge tends to push the material away from the flange 14 and the right edge tends to push the material toward the flange. The material thus tends to rest close to the shallow valley or notch 26 formed by the combination of the left and right edges. Though these edges are separated by the width of the opening, so that the sides of the notch are in different geometric planes, still the effect is to help retain the wound material on the tool as it is being worked. This feature is present with or without a taper to the tube, and the depth of the notch generally increases with an increase in the angle of the cut path.

Figure 3:
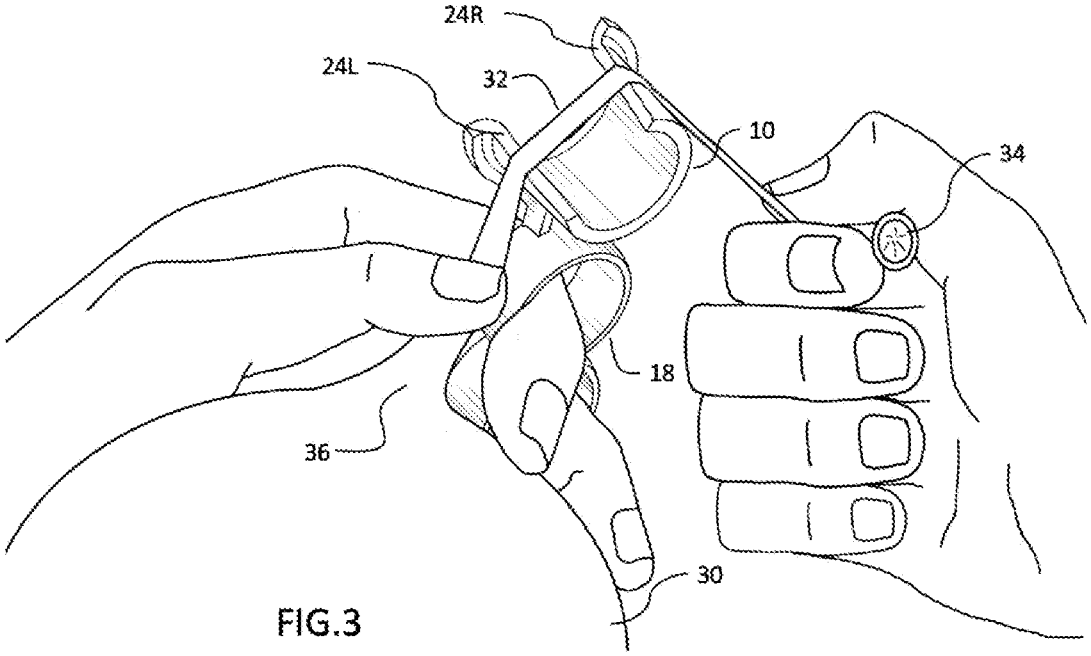
FIG. 3 shows how the tool is typically held when tying a balloon.

Operation-FIGS. 3 and 4

To operate the tool, an inflated but untied balloon is held closed at the lip 34, typically by the user's dominant hand, to prevent the escape of gasses. The operation of the tool first begins by holding it by the handle 18, typically using the index and middle fingers of the nondominant hand, with the tool resting on the intermediate phalanges of those fingers. The independent loops for the two fingers allow greater control of the tool, making it easier to both hold it while not in use and to apply leverage when the elastic balloon material is stretched over it. Instead of curling the fingers to grip the handle, the tool can be lightly held by letting it simply rest on the two fingers, by laterally squeezing the two fingers against the junction of the rings 11 (FIG. 1B), or by splaying those fingers away from the junction and against the opposite walls of the rings. Using the thumb of the tool hand, the balloon body 30 is then pressed against the handle close to the body-neck transition 36. The neck of the balloon 32 is then stretched over the left 24L and right 24R edges of the tool, where the notch (24, FIG. 2B) formed by those two features helps to retain the balloon neck on the tool.

Figures 4A, 4B, 4C:
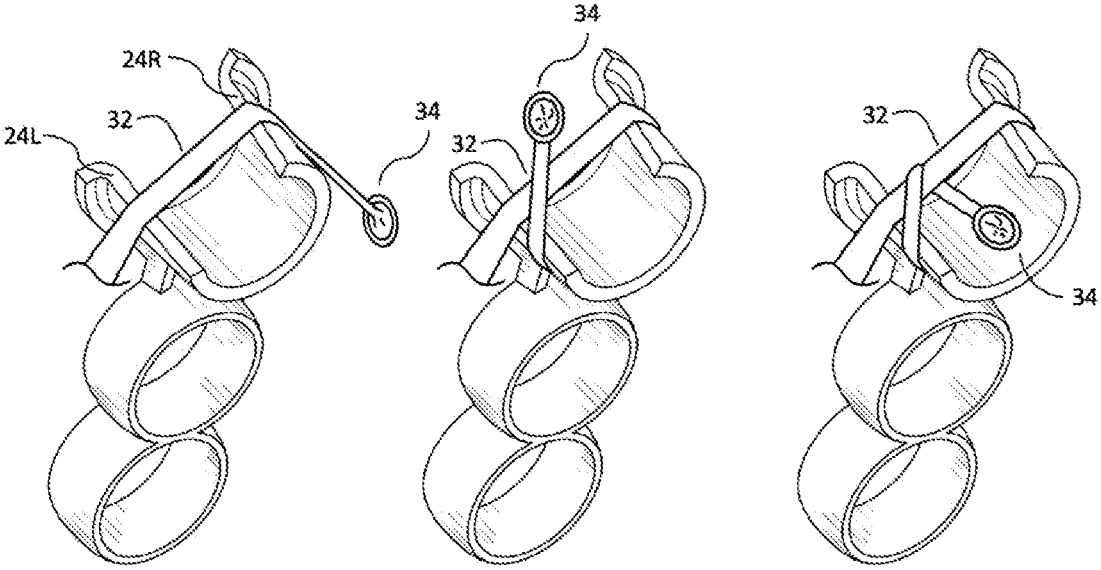
FIGS. 4A to 4C illustrate the process of tying a balloon with the tool.

The completion of the tying operation is shown in FIGS. 4A, 4B, and 4C, where the operator's hands have been hidden and the balloon body cropped to clarify the steps. Once the balloon neck 32 is stretched across the top of the tool as in FIG. 4A, the lip end 34 is then wrapped around the bottom of the tool head 10 and up by the left edge 24L. With a finger of the non-tool hand, the lip end is then wrapped through the opening and around the neck and as in FIG. 4C to form a simple knot, at which point the lip end is pulled forward to remove the balloon neck from the tool and complete the tying process. The tool can then be used to tie other balloons.

FIGS. 5-8 — Additional Embodiments

Figure 5:
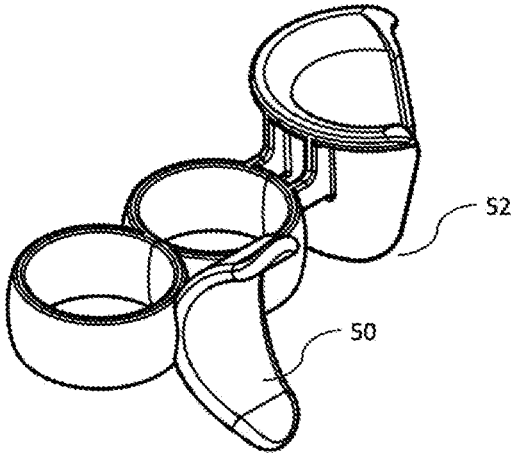
FIG. 5 shows an optional thumb rest.

Additional embodiments are shown in FIGS. 5 and 6. In FIG. 5, a thumb rest 50 is added. The operation is the same as with the first embodiment, except that the thumb rest helps to retain the balloon body and provide a more defined location to grip the body-neck transition.

Figure 6A:
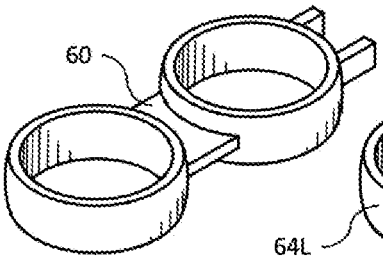
FIGS. 6A to 6C show alternate handle configurations.
Figure 6B:
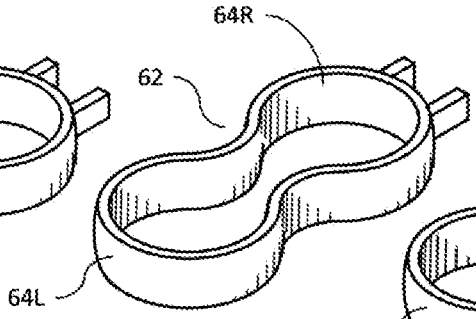
Figure 6C:
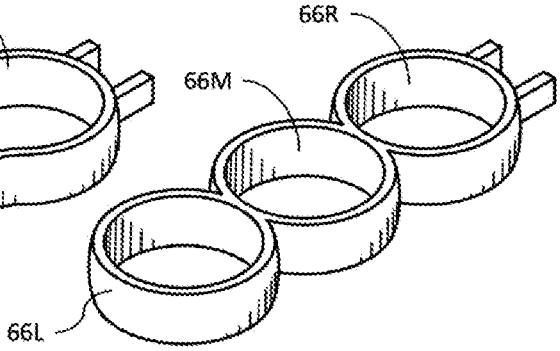

FIGS. 6A, 6B, and 6C illustrate additional embodiments of the handle. In FIG. 6A, a spacer 60 has been added to increase the distance between the finger rings. In FIG. 6B., the two joined finger loops, 64A and 64B, are not independent closed loops, but the narrowing 62 is small enough to retain the index and middle fingers in their respective loops. As such, it preserves the functional benefits of the independent loops 18 (FIG. 1A) though geometrically it is a single aperture. FIG. 6C illustrates that more than two finger loops can be incorporated, as shown by the three loops 66L, 66M, and 66R.

Figure 7A:
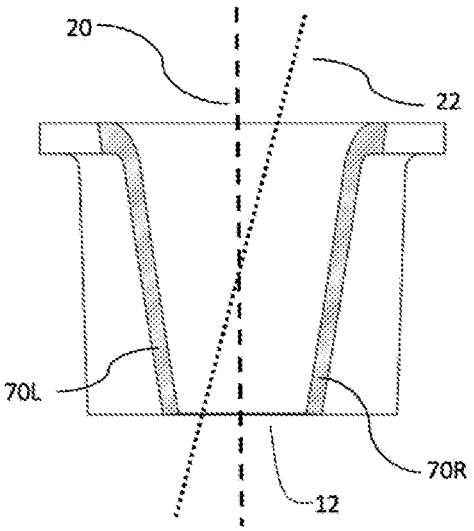
FIGS. 7A and 7B illustrate the front and side views, respectively, of an alternate opening shape in which the left and right edges of the opening are not parallel with each other.
Figure 7B:
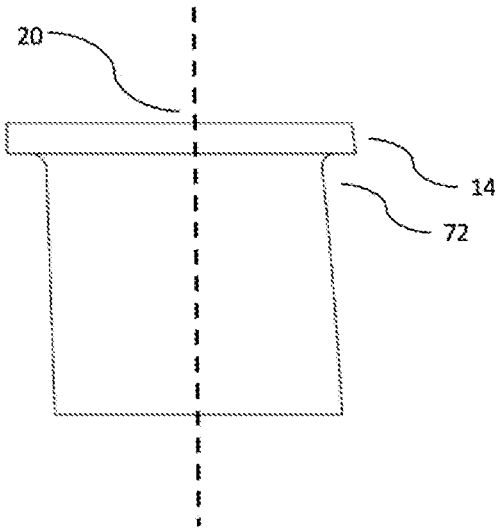

FIGS. 7A and 7B show an alternative embodiment of the opening. Here, the left edge 70L is cut at the negative or opposite angle as the right edge 70R relative to the tool centerline 20, so that the common slope of both edges in the profile view both tend to push the wound material toward the flange 14, acting to help retain it on the tool via a new notch location 72. Generally, the angle of the left and ridge edges need not be identical, nor do the edges need to be linear, so long as their geometry results in the formation of a notch. Additionally, the opening need not run the full length of the tool.

Figure 8:
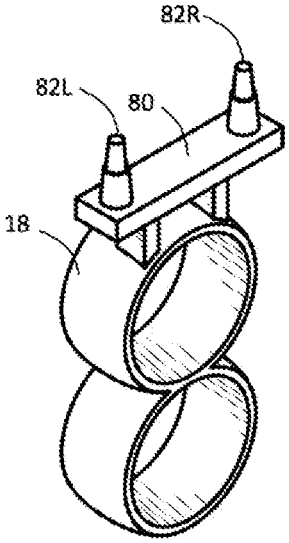
FIG. 8 shows how the handle design can be adapted to other head configurations.

The handle design provides a number of benefits to the user and could be adapted to tying tool designs other than the open tube described in the first embodiment. FIG. 8 shows an alternative embodiment in which a different head 80 is affixed to the handle 18. This illustration is representative of the multi-post type, in which two raised posts 82L and 82R are affixed to the head 80 and form the features used to tie the balloon, but other tying tool head designs could be similarly incorporated.

Advantages

From the description above, a number of advantages of some embodiments of this tying tool become evident:

(a) The tool can be easily retained on one hand without the need to grip the tool by curling the fingers around it, freeing the fingers to perform other tasks.

(b) The independent finger rings on the handle allow better control of the tool than a single large loop.

(c) The tool head location toward the dorsal or back side of the hand frees the palm of the hand to assist with holding the balloon being tied.

(d) The walls of the opening in the tube head create a notch to help retain material on the head even if the tube is tapered.

(e) The design of the tool as a single piece reduces complexity and lowers manufacturing cost.

Conclusion, Ramifications, and Scope

Accordingly, the reader will see that at least one of the embodiments provides a tying tool that can be used to tie inflated balloons simply and easily, that allows simultaneous use of the hands with little encumbrance, and that can be manufactured inexpensively. Furthermore, the tying tool has the additional advantages that:

it can be manufactured with a simple injection mold;

its multi-loop handle provides better control and leverage while tying;

it passively helps retain wound material on the head until purposefully pulled off by the user;

the dimensions of the design can be easily tailored to different hand sizes.

Although the description above contains many specificities, these should not be construed as limiting the scope of the embodiments but as merely providing illustrations of some of several embodiments. For example, the cross-section of the tube can have other shapes, such as oval, elliptical, rectangular, etc.; the opening can extend less than the full length of the tube; the flange can be omitted; the support posts can be omitted so that the handle attaches directly to the head; etc.

Thus the scope of the embodiments should be determined by the appended claims and their legal equivalents, rather than by the examples given.

The invention claimed is:

1. A tool for tying knots comprising:

a hollow tube having a wall and a first and a second end; and a length extending from the first end to the second end; and an opening in the wall extending at least part of the length of the tube, said opening formed by a first substantially straight edge and a second substantially straight edge, wherein the first substantially straight edge and the second substantially straight edge:

each extend as a continuous, substantially straight line from the first end to the second end;

are each non-parallel with a center axis of the tube and are non-parallel or skew to one another; and are angled with respect to one another so that they have different slopes with respect to the center axis of the tube.

2. The tool of claim 1 wherein said tube is attached to a handle comprising a first loop connected to the tube at a first attachment point and a second loop connected to the first loop at a second attachment point substantially opposite the first attachment point thereby permitting the tool to be held by two or more fingers.

3. The tool of claim 1 wherein said opening comprises a gap of approximately constant width extending an entire length of the tube.

4. The tool of claim 3 wherein the tube is attached to a handle, said handle comprising a first loop connected to the tube at a first attachment point and a second loop connected to the first loop at a second attachment point substantially opposite the first attachment point thereby permitting the tool to be held by two or more fingers.

5. A tool for tying knots comprising:

a tapered tube having a wall and a first and a second end;

a length extending from the first end to the second end;

an opening in the wall extending the length of the tube, said opening having a first substantially straight edge and a second substantially straight edge, wherein the first substantially straight edge and the second substantially straight edge:

each extend as a continuous, substantially straight line from the first end to the second end;

are each non-parallel with a center axis of the tube and are non-parallel or skew to one another; and are angled with respect to one another so that they have different slopes with respect to the center axis of the tube; and a handle comprising a first loop connected to the tube at a first attachment point and a second loop connected to the first loop at a second attachment point substantially opposite the first attachment point thereby permitting said tool to be held by two or more fingers.

* * * * *